United States Patent [19]

Donaldson et al.

[11] Patent Number: 4,457,400

[45] Date of Patent: Jul. 3, 1984

[54] EMERGENCY DESCENT DEVICE

[75] Inventors: John M. Donaldson, Grosse Pointe Park; Donn E. Vidosh, Bloomfield Hills; Lars G. Karlsson, Farmington Hills; all of Mich.; Dennis A. Thomas, Las Vegas, Nev.

[73] Assignee: Gernnimo Industries, Ltd., Birmingham, Mich.

[21] Appl. No.: 418,913

[22] Filed: Sep. 16, 1982

[51] Int. Cl.[3] ..... A62B 1/10

[52] U.S. Cl. ..... 182/234; 182/239; 182/75

[58] Field of Search ..... 182/234, 5, 233, 238, 182/231, 235, 239, 3, 4, 6, 7, 75

[56] References Cited

U.S. PATENT DOCUMENTS

| | | | |
|---|---|---|---|
| 286,306 | 10/1883 | Johnson | 182/239 |
| 1,500,943 | 7/1924 | Jolkovski | 182/239 |
| 1,631,279 | 6/1927 | Mandy | 182/235 |
| 2,561,832 | 7/1951 | Wilson | 182/235 |

FOREIGN PATENT DOCUMENTS

| | | | |
|---|---|---|---|
| 1113904 | 3/1978 | Canada | 182/235 |
| 2903403 | 7/1980 | Fed. Rep. of Germany | 182/5 |
| 2259212 | 9/1975 | France | 182/5 |
| 284420 | 2/1928 | United Kingdom | 182/3 |
| 977384 | 12/1964 | United Kingdom | 182/5 |

*Primary Examiner*—Ramon S. Britts
*Assistant Examiner*—Alvin Chin-Shue
*Attorney, Agent, or Firm*—Cullen, Sloman, Cantor, Grauer, Scott & Rutherford

[57] ABSTRACT

A device for lowering a person from a building by dispensing a cable that is anchored on one end to the building. The cable is played out of the device by unwinding the cable from a spool. In one embodiment, the spool rotates on a shaft that has a planetary gear linkage on one end and a centrifugal brake on the opposite end of the shaft. In a manual embodiment a dual disc brake is adapted to engage the ends of the spool for controlling the rate at which the cable is unwound from the spool. In both embodiments the brake is spring biased into engagement to prevent unwinding the cable when no load is placed on the device.

19 Claims, 10 Drawing Figures

EMERGENCY DESCENT DEVICE

BACKGROUND OF THE INVENTION

1. Technical Field

This invention relates to a rescue device for safely lowering people from elevated locations. More specifically, a person harnessed to the device is lowered to the ground, for example from a high-rise building, by gradually unwinding a cable that is attached to the building on one end.

2. Prior Art

If a fire breaks out in a high-rise building, people can be trapped on floors above the range of the fire department rescue equipment. In such instances, there is a need for a device to lower a person from the upper floors of the building. The device must be simple so that it may be learned in an emergency. Such a device must be versatile so that it may be safely used by persons weighing from 50 pounds to 300 pounds. It is important that the device is jam proof and that the descent is controlled at a safe speed. It is preferable that a person using the device be lowered smoothly to the ground without unnerving stops and starts.

Ideally, an emergency descent device would be small enough for a person to pack in a suitcase for use in the event of a hotel fire. A small device also lends itself to being stored in suitable quantities in high-rise buildings.

The emergency descent device must be capable of being stored for use many years after initial installation.

Various winches and safety cable devices are known in the prior art for lowering a person from high-rise buildings. However, all of the prior art devices have suffered from certain deficiencies in their performance, especially when used as personal emergency descent devices.

A primary problem with prior art emergency descent devices is their inability to lower persons of different weight at a controlled, safe rate of speed. The amount of weight attached to prior art devices critically effected the rate of descent. In some prior art devices, as the weight of an object increased, the velocity of descent similarly increased. In other prior art devices, particularly those using a centrifugal clutch, as the weight of an object attached to the device increased, the clutch tended to either lock-up or grab intermittently.

One such device, distributed by Safe-T-Scape Inc. of Nevada, is a self-contained unit housing a spool of high tensile strength cable with a clip at one end of the cable and a harness attached to the unit. The Safe-T-Scape unit uses a centrifugal clutch for controlling the rate at which the cable is dispensed from the unit. One drawback of the Safe-T-Scape device is that no braking action occurs until the unit is rotating at a speed sufficient to engage the centrifugal clutch. When used to jump from a multi-story building, an initial fast descent can be quite frightful, making other persons similarly trapped hesistant to use their own device. Another drawback of the device is that if the user encounters a balcony or ledge on the way down, nothing in the unit would prevent it from continuing down, and striking the person using the device, or continuing its descent past the user creating slack in the steel cable which would suddenly snap taught when the user leaves the ledge or other obstacle subjecting the cable to dangerous stress which could cause it to break. The Safe-T-Scape unit and others like it also have a tendency to jam, especially when a heavy person attempts to use the device. Since a heavy person exerts a large amount of force on the cable, the strain on the clutch mechanism is increased and the clutch may actually lock-up leaving the person suspended in mid-air, perhaps many stories above the ground. When a person using the Safe-T-Scape device finally reaches the ground, they must immediately reach up to stop the descent of the emergency escape device since it can not stop itself.

Another type of emergency descent device is the "fall-stop" device sold by Emar S. A. of France. The fall-stop device is a workman's safety harness unit which is designed to be attached to a beam. The fall-stop device is primarily used in industrial applications where workmen are required to work in high places. In such applications, a workman can be trained to use the device and suitable beams are generally available for anchoring the unit. The fall-stop unit is not appropriate for use in emergency situations because it is not simple to set up and use and a suitable anchoring point would be difficult to locate in emergency situations such as a high-rise fire.

The fall-stop device is subject to some of the same disadvantages as the Safe-T-Scape unit. The fall-stop device uses a centrifugal brake mechanism in which brake shoes are adapted to bear upon a brake drum as a result of centrifugal force. The brake is not biased into engagement with the drum. Therefore, the device requires a certain initial descent velocity before effective braking action is developed. This results in initial acceleration of the user before brake engages. When a heavy person uses the device the initial shock of engaging the brake can cause the device to jam. If the fall-stop device is inverted and the cable is attached to the building while the device is carried by a user, it will be subject to the same disadvantages as the Safe-T-Scape device since it is not capable of stopping itself when the person using the device encounters a stationary object such as a balcony or the ground.

In the fall-stop device the brake drum is not an integral part of the spool which dispenses the cable and therefore the brake portion of the apparatus does not directly cooperate with the spool to control dispensing of the cable. The lack of direct cooperation between the brake and the spool makes the device subject to malfunction and failure. The braking force is applied on only one side of the cable spool which causes the forces on the spool to be unbalanced.

Each of the above noted problems encountered by prior art devices is solved by the present invention as will hereinafter be described.

SUMMARY OF THE INVENTION

The present invention relates to a personalized emergency descent device to be used by an individual to gradually lower the individual to the ground from an elevated location. The brake system of the present invention provides a smooth, controlled descent that should not lock-up or jam under any condition.

The personal emergency descent device of the present invention includes a housing for retaining a shaft upon which a spool containing a cable is journalled for rotation. The cable is played out through an opening in the housing as a user, secured to the device by a harness, descends at a controlled rate of speed. The device includes a brake system interconnecting the non-rotatable housing and the rotatable spool for applying a frictional force to resist rotation of the spool. The device also includes a means for controlling the amount of frictional force applied by the brake system to the spool for controlling the rate at which the cable is pulled from the spool.

Preferably, the brake system includes a biasing spring for maintaining a minimum brake force that is capable of preventing the cable from being dispensed when no load is applied to the device.

In one embodiment of the invention, the spool and shaft upon which the spool is journalled are interconnected by means of a planetary gear mechanism and a centrifugal brake system. The planetary gear mechanism is effective to relate the rotation of the spool to the rotation of the shaft in such a way that the shaft rotates at a predetermined number of revolutions relative to the spool. The brake shoes in this embodiment are attached to the shaft to rotate therewith. By so doing, the frictional force of the brakes is centrifugally developed and is multiplied by the planetary gear mechanism to increase as the number of revolutions of the spool increases. Descent speed is therefore only marginally effected by attaching different amounts of weight to the device.

The planetary gear arrangement comprises an internal gear attached to the side of the spool and a spur gear attached to the shaft. The spur gear is interconnected with the internal gear by means of a plurality of planetary spur gears. This arrangement causes the shaft to rotate in the opposite direction from the spool.

A feedback effect occurs because the friction of the centrifugally actuated brake shoes engaging the drum slows the rotational speed of the spool to which the brake drum is integrally attached. The frictional force exerted by the brakes against the brake drum acts to slow the rotation of the center shaft which transfers the reduction in rotational speed to the spool through the planetary gearing system mounted at the opposite end of the shaft. This results in a balanced brake effect producing a relatively constant descent velocity for different loads.

Another embodiment of the present invention, especially useful for firefighters and other professional rescue personnel, includes a manually variable brake system. The professional model features a dual disc brake system through which a frictional force is developed between the spool and the housing. The frictional force acts to slow the rotation of the spool and may be varied by turning an externally mounted handle to increase or decrease the amount of friction applied by the disc brake system. The handle is attached to the center shaft upon which the spool rotates and may be turned to laterally shift the spool toward or away from the disc brake lining. The spool may be forced by the handle into a locked position wherein rotation of the spool is prevented by the brakes. This arrangement would be particularly useful to a professional rescue worker in dropping from a roof or higher level to an intermediate point on a building to rescue persons trapped at an intermediate level of a building. The descent speed in the professional system is entirely determined by the user and may be increased or decreased as required.

In a preferred embodiment of the professional model, the disc brakes are biased into engagement with the spool at all times by means of a spring to prevent complete free-fall. This is necessary since it is desirable to maintain the speed of descent within controllable limits for even professional emergency rescue personnel.

These and other advantages of the present system will be better understood after studying the attached drawings in view of the following description of two preferred embodiments of the present invention.

DETAILED DESCRIPTION OF THE PREFERRED EMBODIMENT

Figure 1:
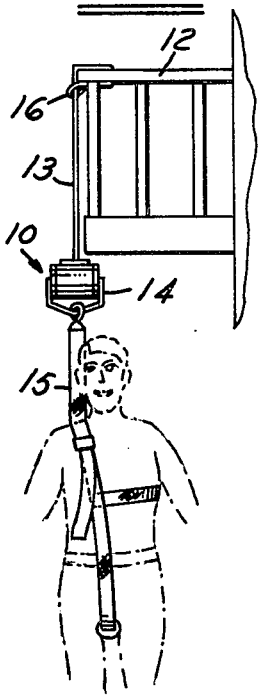
FIG. 1 is an elevational view of the emergency descent device of the present invention attached to a building and having a person harnessed thereto.

The emergency descent device, generally indicated by the reference numeral 10, is shown in its operative orientation in FIG. 1. The emergency descent device 10 is attached to a building 12 by means of a cable 13 to lower a person from the building 12. A yoke 14 is provided on the emergency descent device 10 for securing a harness to the device. An anchoring means 16 is provided on one end of the cable 13 for securing the device to the building 12.

Figure 2:
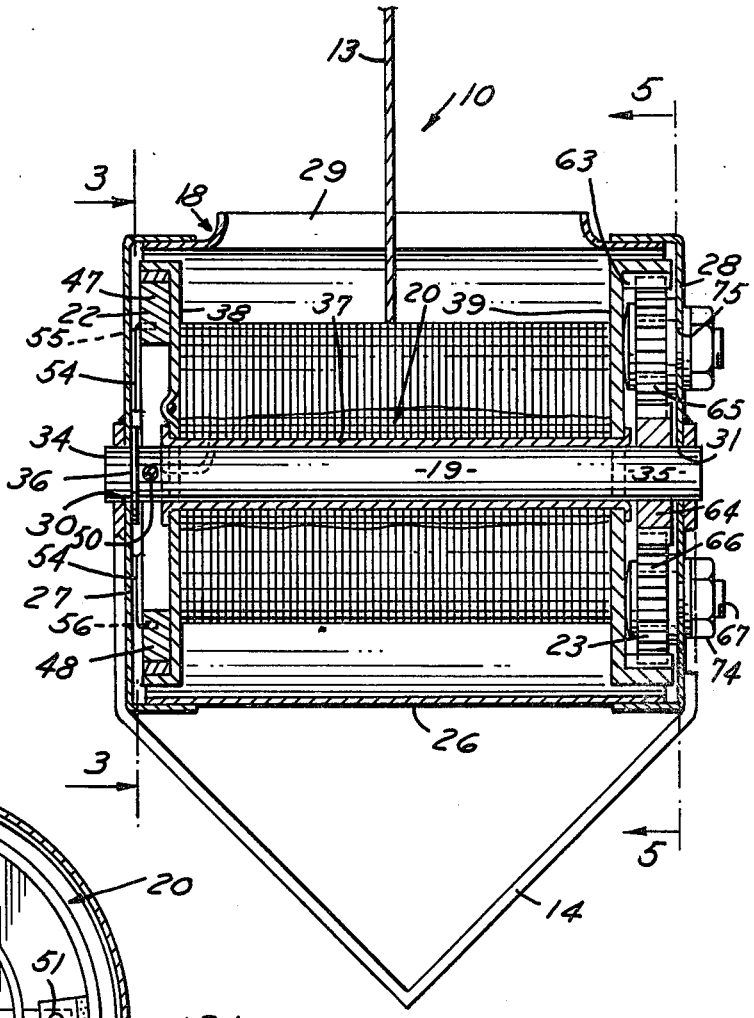
FIG. 2 is a cross-sectional view of the device taken through the central vertical plane.

As shown in FIG. 2, an automatic emergency descent device 21 comprises a housing, generally indicated by the reference numeral 18, which is fabricated from steel. A shaft 19 is journalled for rotation in the central part of the housing 18. A spool 20 is disposed on the shaft 19 within the housing 18 for rotating on the shaft. A brake system 22 is secured to one end of the shaft 19 to engage a portion of the spool 20 for exerting a frictional force therebetween. A planetary gearing system 23 is attached to the opposite end of the shaft 19 to interconnect the shaft 19 and the spool 20 causing them to rotate in opposite directions relative to one another.

Figure 3:
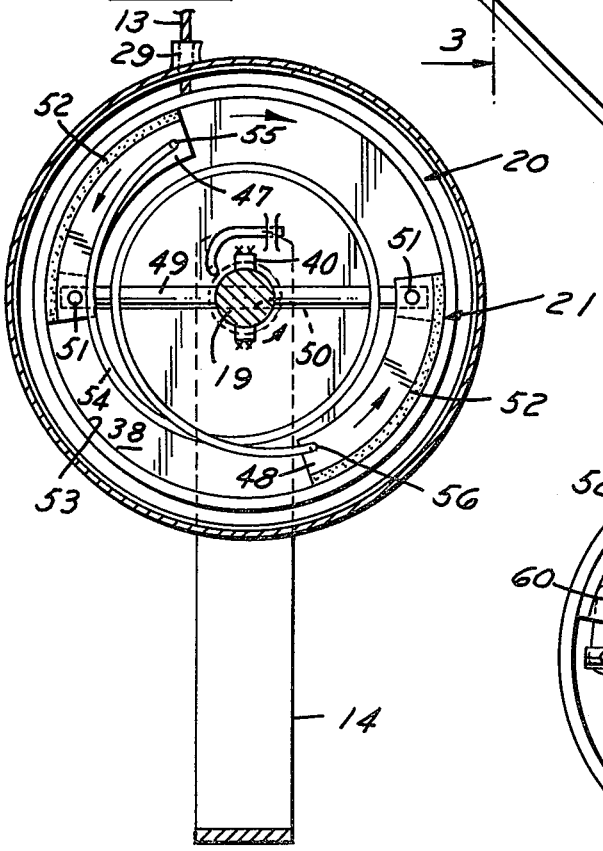
FIG. 3 is a cross-sectional view of the brake system in the device taken along lines 3—3 in FIG. 2.

The housing 18 includes a cylindrical body 26 which is closed by a first end cap 27 enclosing the brake system 22 and a second end cap 28 enclosing the planetary gearing system 23. An elongated slot 29 is preferably provided in the cylindrical body 26. Elongated slot 29 is aligned with the central axis of the cylindrical body 26 as shown in FIGS. 2 and 3. The elongated slot 29 is elongated in shape to facilitate unwinding the cable from the spool, but may be an otherwise shaped opening if desired. The first end cap 27 has a first central opening 30 for receiving the brake end 34 of the shaft 19. A second central opening 31 is formed in the second end cap 28 for receiving the gear end 35 of the shaft therethrough. If desired, a lock ring 36 may be provided on the brake end 34 of the shaft adjacent the first end cap 27 to prevent the brake system 22 from sliding into the end cap 27.

Figure 7:
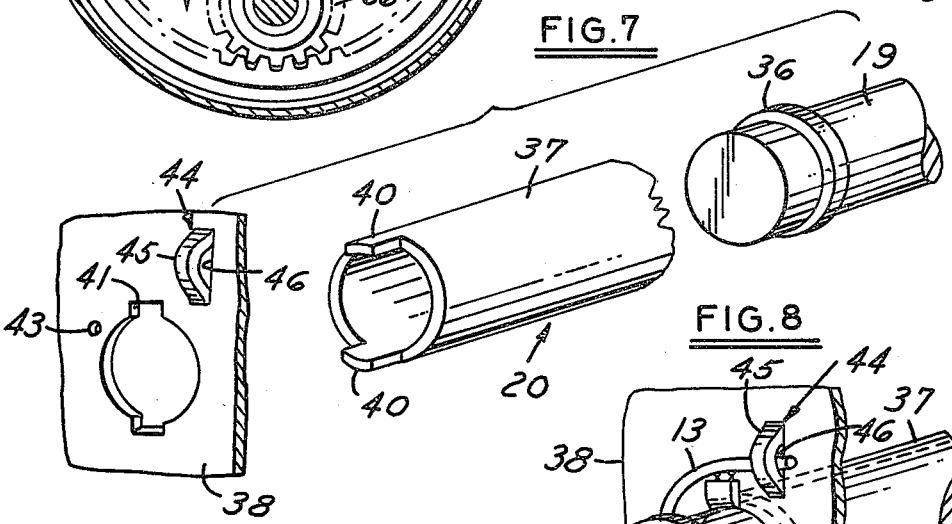
FIG. 7 is a partial exploded perspective view of the shaft and one end of the spool.
Figure 8:
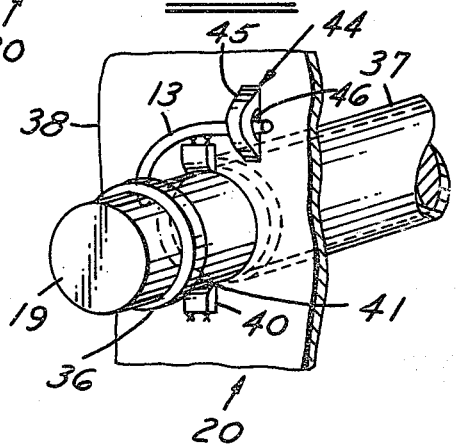
FIG. 8 is a partial perspective view of the shaft and spool as shown in FIG. 7 assembled together.

The spool 20 includes a hub 37 and first and second end plates 38 and 39. As shown in FIGS. 7 and 8, the hub 37 is a tubular member that is secured to first and second end plates 38 and 39 by means of tabs 40 formed on each end which is received within notches 41 in the first and second end plates 38 and 39. The shaft 19 is journalled within the hub 37 to permit relative rotation between the shaft 19 and the hub 37. As shown in FIG. 8, the cable 13 is secured to the first end plate 38 by a clamping arrangement wherein the cable extends through a hole in the end plate 43 and into a cable end clamp 44. The cable end clamp comprises a tongue 45 and slot 46 stamped in the end plate 38 between which the cable 13 is clamped.

Referring now to FIGS. 2 and 3, the brake system 22 is shown to comprise first and second brake shoes 47 and 48 on opposite ends of a rigid support rod 49. The support rod 49 is received within a bore 50 in the brake end 34 of the shaft 19. First and second brake shoes 47 and 48 are attached to the support rod 49 by means of a pivot pin 51. The first and second brake shoes 47 and 48 each include a lining 52 of brake material to provide a friction surface for engagement with the brake drum 53 which is formed integrally with the first end plate 38 of the spool 20. The lining 52 of the brake shoes is pressed into engagement with the brake drum 53 at all times by the spring 54 which is attached on a first end 55 to the first brake shoe 47 and on a second end 56 to the second brake shoe 48. The spring 54 is preferably a spring wire member comprising one and one-half loops of spring wire, the first and second ends 55 and 56 of which are biased outwardly.

Figure 4:
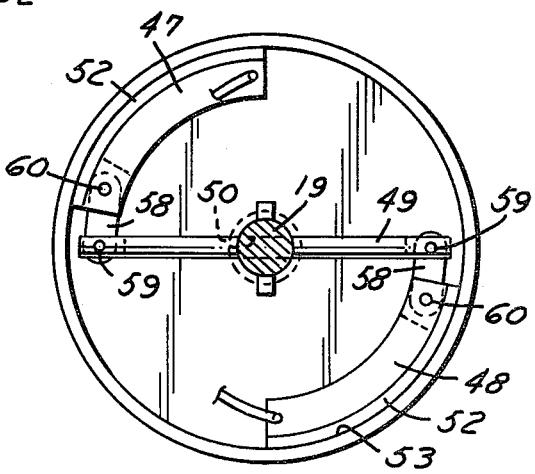
FIG. 4 is a cross-section of a modified brake system taken from the same perspective as FIG. 3.

As shown in FIG. 4, a modified brake system may be provided wherein a link 58 is provided between the support rod 49 and each of the first and second brake shoes 47 and 48. The link 58 is connected to the rod 49 by a first pivot pin 59 and to one of the brake shoes by a second pivot pin 60. In this arrangement, full contact of the lining 52 with the brake drum 53 is assured which increases the frictional force between the lining 52 and the brake drum 53.

Figure 5:
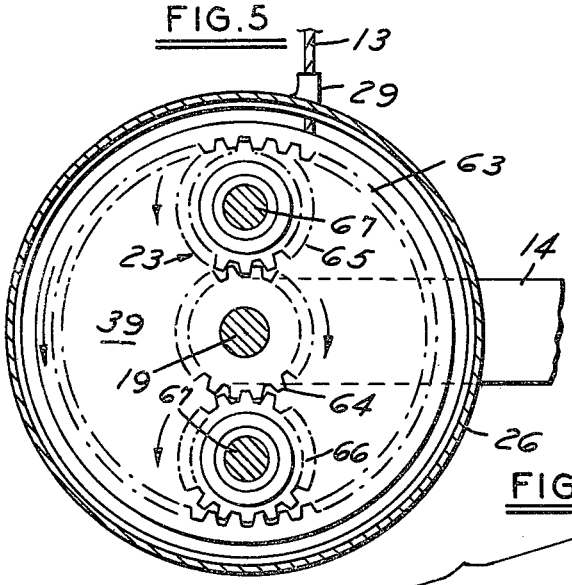
FIG. 5 is a cross-sectional view of the planetary gear mechanism taken along line 5—5 in FIG. 2.
Figure 6:
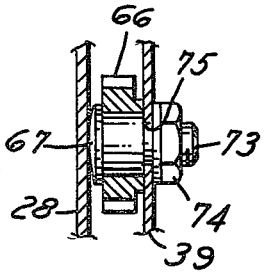
FIG. 6 is a broken-away cross-sectional view of a planetary spur gear as mounted on the end of the housing of the device.

As shown in FIGS. 2 and 5, the planetary gear system 23 includes an internal ring gear 63 that is fastened to the second end plate 39. The second end plate may be either a flat member having the internal ring gear pinned thereto or the second end plate may be a cupped shaped member having flanges extending from the second end cap 28 to which the internal ring gear 63 is fastened by welding, pins or other well known fastening means. A central spur gear 64 is securely attached to the gear end 35 of the shaft 19. First and second planetary gears 65 and 66, as shown in FIG. 6, are journalled on a gear pin 67 which has a threaded end 73 that extends through an opening in the housing 75 and is retained thereon by means of a nut 74.

Figure 9:
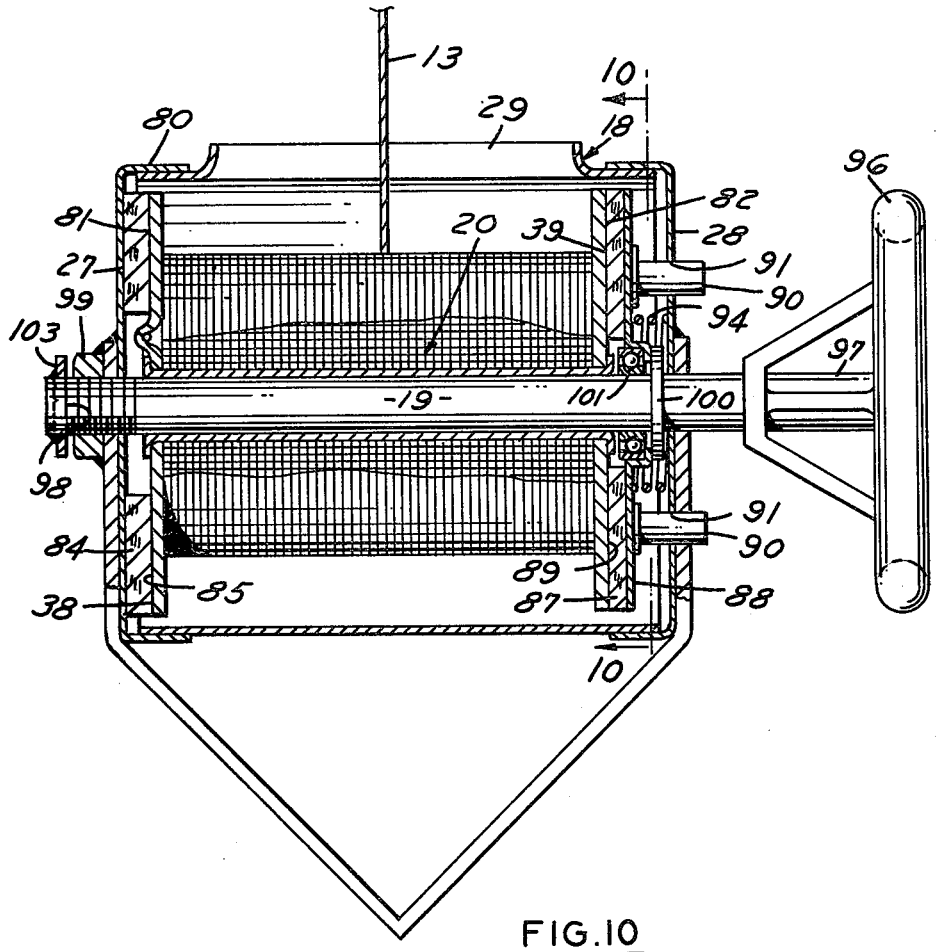
FIG. 9 is a central cross-sectional view of a manually operated embodiment of the present invention.
Figure 10:
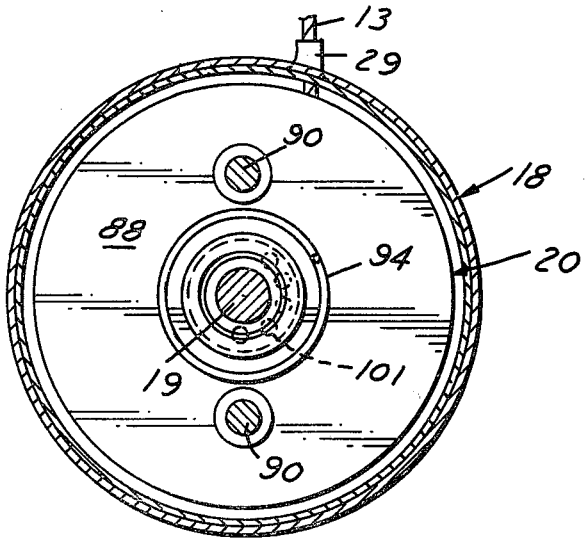
FIG. 10 is a side cross-sectional view of the embodiment shown in FIG. 9 taken along line 10—10 in FIG. 9.

A manually operated emergency descent device, shown in FIGS. 9 and 10 and being generally indicated by the reference numeral 80, comprises a dual disc brake system that is manipulated by the user of the device to manually control the speed of descent. As shown in FIG. 9, the manual system 80 includes a first disc brake 81 between the spool 20 and the first end cap 27. The second disc brake 82 is located on the opposite side of the spool 20 from the first disc brake 81.

The first disc brake 81 includes first disc brake lining 84 which is secured to the first end cap 27 by an adhesive or other fastening means. The outer face of the first end plate 38 of the spool 20 is in face to face engagement with the first disc brake lining 84 and is in sliding frictional engagement with the first disc brake lining 84.

The second disc brake lining 87 is secured to a brake plate 88 to be in sliding frictional face to face engagement with the outer face 89 of the second end plate 39 of the spool 20. The brake plate 88 and the second disc brake lining 87 are attached by means of an adhesive or other fastening means. The brake plate 88 has two anti-rotation pins 90 extending from the side opposite the second disc brake lining 87 through openings 91 formed in the second end cap 28 of the housing 18. The anti-rotation pins 90 are slidable within the openings 91 to permit the brake plate to move toward and away from the spool 20 to increase the frictional force created by the disc brakes 81 and 82.

First and second disc brake linings 84 and 87 are constantly engaged by outer face 85 and outer face 89 because of the compression spring 94 that is disposed on the central shaft 19 between the second end cap 28 and the brake plate 88. The compression spring 94 urges the brake plate 88 and second disc brake lining 87 into engagement with the outer face 89 of the spool 20. The spool 20 is in turn urged toward the first end cap 27 which causes the outer face 85 of the spool 20 to bear against the first disc brake lining 84. By so doing, an equalized frictional force is exterted on both sides of spool to inhibit rotation thereof.

The manual system 80 provides an emergency descent device 10 having a variable speed of descent. The braking force exerted by first and second disc brake systems 81 and 82 may be varied by manually turning the handle 96 which is secured to the extended portion 97 of the shaft 19. The opposite end of the shaft 19 includes a threaded end 98 that is received within a nut 99 that is welded to the first end cap 27. An annular flange 100 is secured to the shaft 19 between the second end plate 39 and the brake plate 88. The annular flange 100 is adapted to engage the brake plate 88 to transfer axial movement of the shaft 19 to the first and second disc brakes 81 and 82. A ball bearing 101 is provided in the preferred embodiment shown in FIG. 9 and 10 on the inner annular edge of the brake plate 88 to permit turning of the shaft relative the brake plate 88. An end stop 103 is welded, or otherwise attached to the threaded end 98 of the shaft 19 to prevent distortion of the housing 18 caused by moving the shaft 19 too far to the right.

Operation of the automatic descent device 21 will be described with reference to FIGS. 1 through 8. The automatic descent device is one best suited for use by individuals and does not require special training. To use the device, the cable 13 is securely attached to a railing of a balcony as shown in FIG. 1 or other immovable portion of a building 12 in the event of a fire or other emergency requiring evacuation from an elevated location, such as a building. The cable 13 is secured to the building by an anchoring means 16 and the harness 15 is attached to the yoke 14 which is attached to the outside of the emergency descent device 10. The person using the device straps themself to the harness 15, the attaches the harness 15 to the unit 10 and exits the building while being supported by the emergency descent device 21.

When the user's weight is transferred to the harness, the cable 13 will begin to be gradually pulled from the emergency descent device 21 thereby lowering the user at a controlled rate of speed to the ground.

The cable is controlled as it is played out from the device by the co-action of the brake system 22 and the planetary gear system 23. The cable 13 is pulled through the slot 29 and off of the spool 20 which causes the spool to rotate in the counter-clockwise direction as viewed in FIG. 5. Rotation of the spool 20 causes the internal ring gear 63 attached to the second end plate 39 to rotate in the same direction. The internal ring gear in turn engages the first and second planetary gears 65 and 66 causing them to rotate in the counter-clockwise direction as viewed in FIG. 5. Both of the first and second planetary gears 65 and 66 then engage the central spur gear 64 causing it to rotate in the clockwise direction as viewed from the gear end 35 of the unit.

On the opposite end of the shaft 19, as viewed in FIGS. 3 and 4, the shaft rotates counter-clockwise and turns the support rod 49 in the same direction which in turn rotates first and second brake shoes 47 and 48 in the counter-clockwise direction. As viewed in FIG. 3, the brake drum 53 rotates clockwise, in the opposite direction relative to the brake shoes 47 and 48. The action of the brake shoes 47 and 48 against the drum 53 creates a frictional braking force that slows the rotation of the brake shoes and the drum. This slowing action is communicated through shaft to the gearing mechanism to create a balanced braking force on both sides of the drum 53.

The planetary gear system 23 in a preferred embodiment has a gear ratio of the internal gear 63 to the central spur gear 64 of 3 to 1 so that the central shaft rotates three revolutions in one direction for each revolution of the spool in the opposite direction. The high number of rotations for the shaft increases centrifugal force of the brake shoes against the brake drum. The increased centrifugal force results in an increased friction and braking action. As the speed of rotation of a rotated body increases, the centrifugal force generated by that body increases exponentially. The increase in centrifugal force reduces the change in the speed of descent caused by persons of different weight using the device. For example, test using the automatic emergency descent device have resulted in the determination that doubling the weight attached to the harness will only increase the descent velocity 10 to 16 percent.

Operation of the manual emergency descent device 80 will be explained with reference to FIGS. 9 and 10. The manual device 80 is set up for use in the same way as the automatic device 21 depicted in FIG. 1. However, the braking and control mechanisms are significantly different.

After the cable 13 is attached to part of the building 12 and the user is in the harness 14, the user turns the handle 96 to release first and second disc brakes 81 and 82. Thereafter, the speed of descent may be slowed or stopped by turning the handle in the opposite direction. If additional descent speed is desired the handle 96 may be turned to further release first and second disc brakes 81 and 82.

When the handle is turned to release the disc brakes the threaded end 98 of the shaft 19 is turned within the nut 99 which moves the shaft 19 in the direction of the axis of the shaft 19. Movement of the shaft 19 to the left as viewed in FIG. 9 results in an increase in braking force. While movement to the right reduces braking force.

When the shaft 19 moves to the left the annular flange 100 pushes against the brake plate 88 which moves the second brake lining 87 into tighter engagement with the outer face 89 of the spool 20. The spool 20 is at the same time shifted to the left, causing the outer face 85 to press against the first brake lining 84 to increase the braking force.

Moving the shaft 19 to the right causes a reversal of the movements described in the prior paragraph.

One unique feature of the present invention according to both embodiments is that a biasing force is constantly applied to the braking system to create a braking force sufficient to prevent the device from beginning its descent without the weight of a user pulling on the device. In the automatic system, the urging force of the spring 54 moving the first and second brake shoes 47 and 48 into engagement with the brake drum 53 is sufficient to prevent rotation when the device is suspended by the cable.

This feature results in several advantages. One, if the emergency device 10 is placed over the side of a building before the harness is attached to the user, the device will not begin its descent until the person is attached to the harness. In the course of descent, if a user encounters a ledge or balcony and momentarily interrupts the descent, the unit will not continue to travel downwardly since the braking force developed by the spring and brake shoes will stop the emergency escape device. This is desirable since if the emergency escape device were permitted to continue downwardly the user could be struck by the device. This feature also permits the device to stop itself once the user has reached the ground or in the event that the user stops at an intermediate level and wishes to leave the device temporarily. When the users weight is removed from the harness the spring acting on the brake stops the descent of the device eleminating the chance that the device will continue downwardly and strike the user or develop dangerous slack in the cable, as was possible in prior art emergency descent devices.

Likewise, in the manual mode the constant spring pressure exerted by the compression spring 94 prevents the device from descending when suspended from the cable as a result of its own weight. The brake pressure exerted by the compression spring 94 is also useful in maintaining a certain amount of braking force to limit the speed of free-fall to controllable amounts. Likewise, when the user reaches the ground the device automatically stops its descent by the action of the spring compression force exerting a minimum brake effect. This feature allows a user to leave the device at an intermediate height and return at a subsequent time to continue the descent.

It should be understood that the description of the above embodiments of the present invention are to be construed as illustrative and not by way of limitation.

Having fully described two operative embodiments of the present invention, I now claim:

1. An emergency descent device comprising:

a housing having an opening through one side;

a shaft extending through the housing being journalled for rotation in openings formed in opposite ends of the housing;

a spool journalled for rotation relative to the shaft and the housing, said spool being located inside the housing;

a cable being wound about said spool, and being adapted to be pulled from said spool through the opening in the housing;

said cable having a first end secured to the spool and a second end disposed outside said housing;

a brake system connected to a first end of said shaft to engage a first end of said spool for applying a frictional force to resist rotation of the spool said brake system including a centrifugally actuated means connected to the shaft for increasing the frictional force applied to resist rotation of said spool; and means attached to a second end of said shaft and a second end of said spool for controlling the rate of rotation of the shaft to control the amount of frictional force applied by said brake system and produce a balanced braking action and a substantially constant descent velocity for different loads.

2. In the emergency descent device of claim 1 wherein said controlling means is a plurality of gears.

3. In the emergency descent device of claim 2 wherein said gears comprise an internal ring gear attached to the spool, a central spur gear attached to the shaft, and a plurality of intermediate spur gears disposed between the internal ring gear and the central spur gear to form a planetary gearing system.

4. In the emergency descent device of claim 3 wherein said planetary gearing system causes the central spur gear to rotate relative to the internal ring gear at a ratio of 3 revolutions to 1 revolution.

5. In the emergency descent device of claim 1 wherein said shaft rotates in the one direction and said spool rotates in the opposite direction.

6. In the emergency descent device of claim 1 wherein said brake system comprises a brake drum attached to said spool concentric with the shaft, and a plurality of brake shoes attached to a support member which is secured to said shaft, said brake shoes being disposed on the support member to bear upon the brake drum when said shaft is rotated as a result of the centrifugal force created by rotation of the brake shoes.

7. In the emergency descent device of claim 6 including means for biasing the brake shoes into engagement with the brake drum.

8. In the emergency descent device of claim 7 wherein said biasing means is a spring attached to each brake shoe.

9. An emergency descent device comprising:

a housing having an opening through one side;

a shaft rotatably retained within said housing;

a spool journalled on said shaft inside said housing for rotation relative to the shaft and the housing;

a cable attached on a first end to the spool and having a second end disposed outside of the housing;

said cable being wound about said spool a plurality of times and extending through said opening in the housing, said spool being adapted to be rotated by pulling said cable out of said housing;

means for anchoring the second end of the cable to a building;

means for rotatably interconnecting the shaft and the spool at a first end of said shaft;

said interconnecting means causing the spool to rotate a predetermined fraction of a revolution for each revolution of the shaft;

means for frictionally resisting relative rotation between the shaft and the spool at a second end of the shaft;

said interconnecting means and said resisting means are both connected to the same shaft to cause the slowing action induced by the resisting means to be communicated through the shaft to the interconnecting means for creating a balanced braking force on both sides of the spool to control the rate the cable is pulled out of said housing by controlling the frictional resistance between the shaft and the spool as a function of the rate the cable is pulled out of the housing, to thereby allow an object secured to said device to be controllably lowered from the building.

10. In the emergency descent device of claim 9 wherein said interconnecting means is a plurality of gears.

11. In the emergency descent device of claim 10 wherein said gears comprise an internal ring gear attached to the spool, a central spur gear attached to the shaft, and a plurality of intermediate spur gears disposed between the internal ring gear and the central spur gear to form a planetary gearing system.

12. In the emergency descent device of claim 11 wherein said planetary gearing system causes the central spur gear to rotate relative to the internal ring gear at a ratio of 3 revolutions to 1 revolution.

13. In the emergency descent device of claim 9 wherein said shaft rotates in the one direction and said spool rotates in the opposite direction.

14. In the emergency descent device of claim 9 wherein said brakes comprise a brake drum attached to said spool to be concentric with the shaft, and a plurality of brake shoes pivotably attached to a support member which is secured to said shaft, said brake shoes being disposed on the support member to bear upon the brake drum.

15. In the emergency descent device of claim 14 wherein each of said brake shoes are connected to said support member by a link which enables one side of said brake shoes to fully engage said brake drum.

16. In the emergency descent device of claim 14 including means for biasing the brake shoes into engagement with the brake drum.

17. In the emergency descent device of claim 16 wherein said biasing means is a single spring attached to each brake shoe.

18. In the emergency descent device of claim 17 wherein said spring exerts sufficient force on said brake shoes to prevent rotation of said spool until a predetermined force is applied to the cable.

19. In the emergency descent device of claim 18 wherein said predetermined force is greater than the weight of said emergency descent device.

* * * * *